US007039962B2

(12) United States Patent
Romfeld

(10) Patent No.: US 7,039,962 B2
(45) Date of Patent: May 9, 2006

(54) REARWARD WASH BASIN COMPRISING A NECK SEAL

(75) Inventor: Hartmut Romfeld, Alsbach-Haehnlein (DE)

(73) Assignee: Wella AG, Darmstadt (DE)

( * ) Notice: Subject to any disclaimer, the term of this patent is extended or adjusted under 35 U.S.C. 154(b) by 190 days.

(21) Appl. No.: 10/487,123

(22) PCT Filed: Sep. 4, 2002

(86) PCT No.: PCT/EP02/09915

§ 371 (c)(1),
(2), (4) Date: Feb. 19, 2004

(87) PCT Pub. No.: WO03/028500

PCT Pub. Date: Apr. 10, 2003

(65) Prior Publication Data

US 2004/0177436 A1 Sep. 16, 2004

(30) Foreign Application Priority Data

Sep. 29, 2001 (DE) ..... 101 48 382

(51) Int. Cl.
*A45D 44/10* (2006.01)

(52) U.S. Cl. ..... 4/519; 4/523; 5/655.3

(58) Field of Classification Search ..... 4/519, 4/523, 575.1; 5/644, 655.3; 297/404
See application file for complete search history.

(56) References Cited

U.S. PATENT DOCUMENTS

| | | | | |
|---|---|---|---|---|
| 2,521,780 | A * | 9/1950 | Dodd | 4/523 X |
| 2,897,520 | A * | 8/1959 | Bradford | 5/655.3 X |
| 3,533,113 | A * | 10/1970 | Stamberger | 5/655.3 X |
| 4,327,452 | A * | 5/1982 | Swatzell | 4/523 |
| 5,377,365 | A | 1/1995 | Hakim | 4/519 |

FOREIGN PATENT DOCUMENTS

| | | |
|---|---|---|
| DE | 11 74 024 B | 7/1964 |
| EP | 0 103 112 A1 | 3/1984 |

* cited by examiner

*Primary Examiner*—Robert M. Fetsuga
(74) *Attorney, Agent, or Firm*—Michael J. Striker

(57) ABSTRACT

The rearward wash basin has a neck cutout (5) for performing a rearward head or hair washing and a soft elastic neck seal (6) lining the neck cutout. In order to fit the neck of the individual whose head or hair is being washed, the soft elastic neck seal (6) is in the form of a first bellows (8) with folds (9), the neck seal (6) is provided with a hollow chamber (7) and the folds (9) have a curvature essentially corresponding to that of the neck cutout (5). The neck seal (6) can be equipped with an expansive displacement device (10, 10.1), which adjusts the neck seal to the user's neck.

10 Claims, 5 Drawing Sheets

REARWARD WASH BASIN COMPRISING A NECK SEAL

BACKGROUND OF THE INVENTION

The present invention relates to a rearward wash basin comprising a neck cutout for performing a rearward head or hair washing, whereby the area of the neck cutout is lined with a soft elastic neck seal.

Wash basins made of porcelain, metal or plastic for head or hair washing that are typically used in hairdressing salons are common around the world. To use them, the rearward part of the neck below the head is placed in a neck cutout provided for this purpose. The washing procedure is often uncomfortable or even painful for a salon customer, due to:

Placement of the cervical spine against a hard surface.

Sensation of pressure caused by a poor-fitting neck cutout in the wash basin.

Unpleasant sensation caused by the cold material of the rearward wash basin.

Water running along the back of the neck and into the clothing, caused by leakage in a neck cutout.

Although EP 0 103 112 A1, which represents the general class of claim 1, is known, the sealing ability of the flexible neck seal is not adequate for providing a fluid-tight fit for every neck size. The inadequate sealing ability is due to inadequate conformation to the neck. Optimum conformation to the neck is also prevented by the fact that said rearward wash basin has already been designed with an optimized neck cutout in a porcelain basin, and this neck cutout is made even tighter when the neck seal is installed.

SUMMARY OF THE INVENTION

The object of the present invention is to provide a rearward wash basin that is equivalent to the general class, but does not have the disadvantages listed hereinabove. In particular, an optimum and comfortable, fluid-tight seal between a customer's unique neck and a neck seal on a rearward wash basin will be provided that has no disadvantages for the customer.

This object and others, which will be made more apparent hereinafter, are attained in a rearward wash basin comprising a neck cutout for performing a rearward head or hair washing and a soft elastic neck seal lining the neck cutout.

According to the invention the neck seal is in the form of a first bellows with folds, the neck seal is provided with a hollow chamber and the folds of the bellows have a curvature essentially corresponding to that of the neck cutout.

The invention will be explained in greater detail with reference to three exemplary embodiments.

BRIEF DESCRIPTION OF THE DRAWING

The invention will be explained in greater detail with reference to three exemplary embodiments, which are shown in the accompanying figures, wherein.

DETAILED DESCRIPTION OF THE INVENTION

Figure 1:
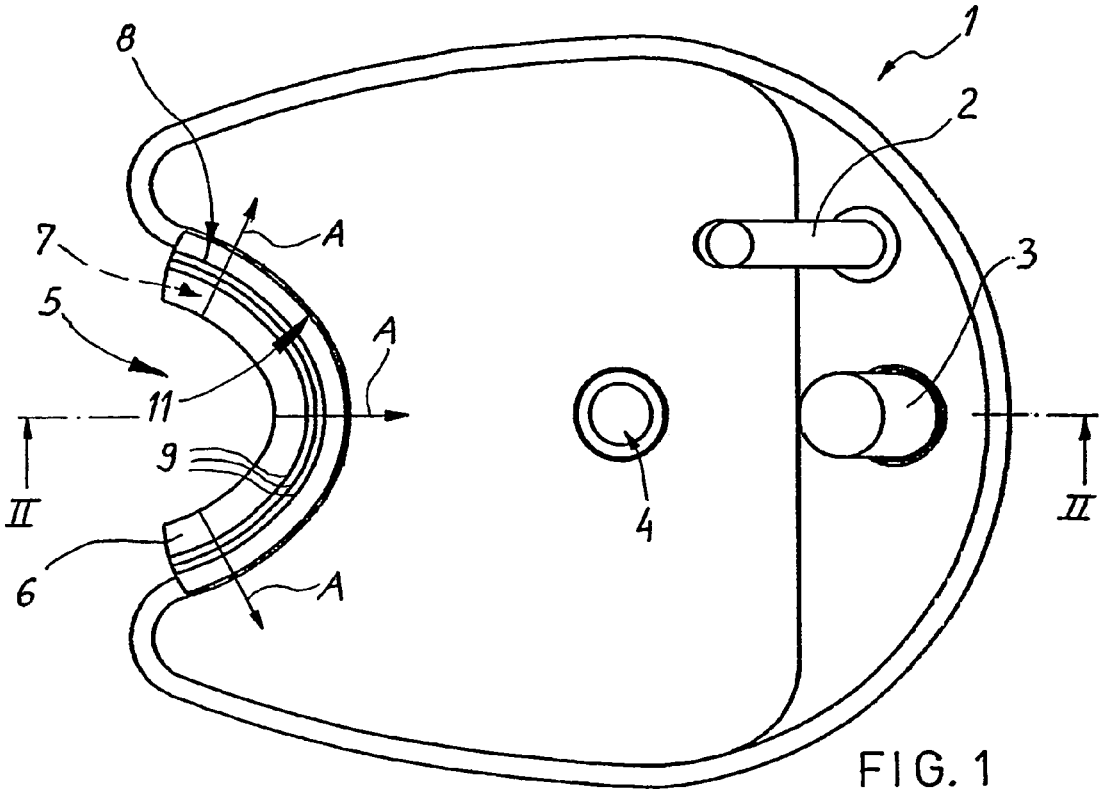
FIG. 1 shows a top view of a rearward wash basin with a neck seal, as a first exemplary embodiment.

FIG. 1 shows a rearward wash basin 1, which is typically outfitted with a shower hose 2, a mixer tap 3, and a drain 4, and has a neck cutout 5 for performing a rearward head or hair washing, whereby the area of neck cutout 5 is lined with a soft flexible, fluid-tight neck seal 6. Neck seal 6 is equipped with a hollow chamber 7, whereby neck seal 6 is provided in the form of a bellows 8. Folds 9 have a curvature that essentially corresponds to that of the neck cutout 5. Bellows 8 is designed such that a central range of motion A of approximately 20 mm is possible, by means of which a tailored conformation to a customer's neck is ensured.

Figure 2:
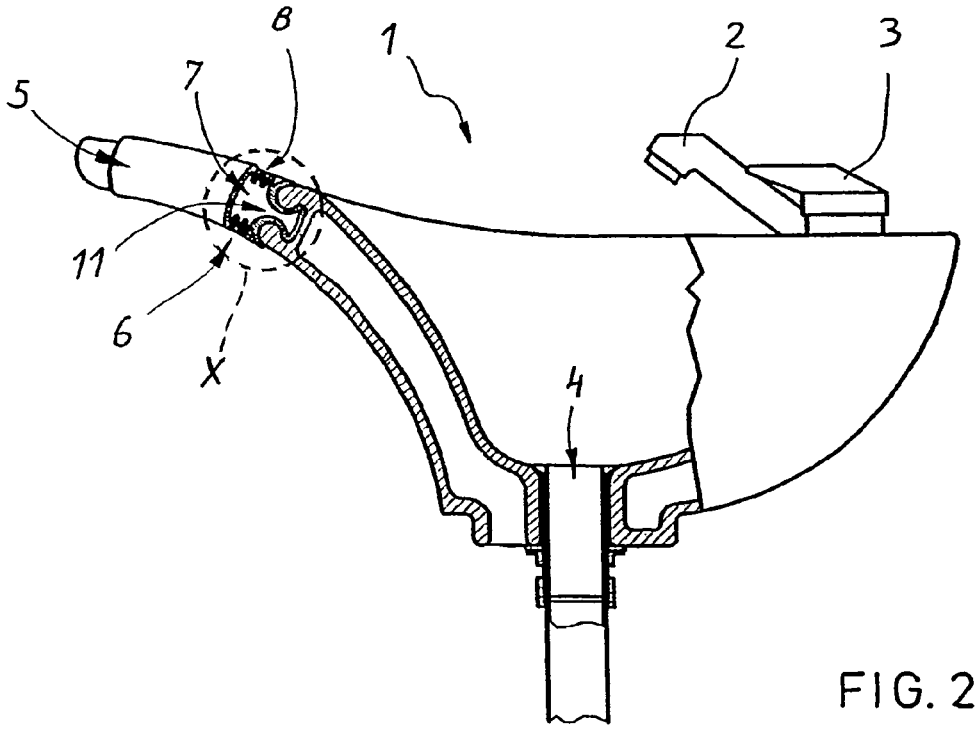
FIG. 2 is a partially side, partially sectional view of the rearward wash basin of FIG. 1 taken along the section line II—II of FIG. 1.

FIG. 2 shows, in a first exemplary embodiment, a neck seal 6 for the automatic adjustment of a fluid-tight fit against a customer's neck. Neck seal 6 has a hollow chamber 7 that is provided in the form of a bellows 8. Conformation to a customer's neck is enabled via the elasticity of bellows 8 (central displacement path A). To prevent the air from being compressed in bellows 8, which is closed per se, and/or neck seal 6, an air supply and relief opening B can be provided in a suitable (lower) location.

Figure 3:
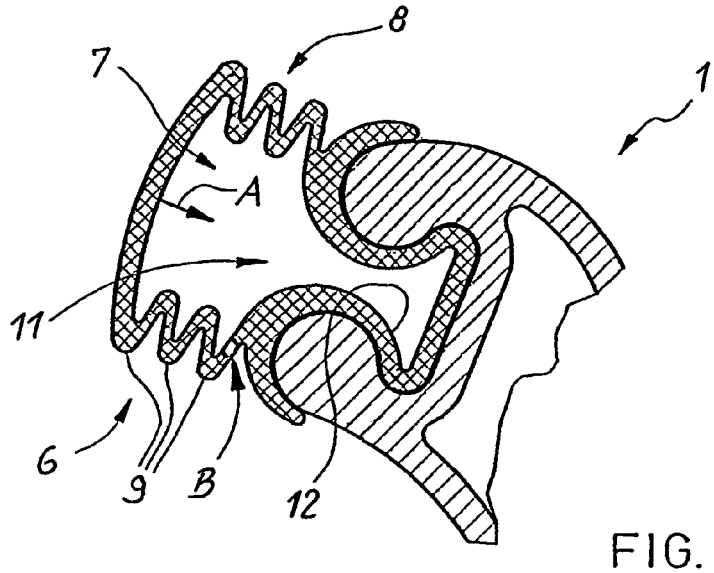
FIG. 3 is a detailed view of a circle region "X" of the neck seal according to FIG. 2.

FIG. 3 shows a detained view X according to FIG. 2, and, in particular, a groove-like recess 11 in the area of neck cutout 5 of rearward wash basin 1, which serves to accommodate neck seal 6, whereby neck seal 6 is provided with a complementary recess profile 12 for this purpose, which clamps together with recess 11 in fixed fashion. The curvature of neck cutout 5 of recess 11 of rearward wash basin 1 must be sized greater than the curvature of neck cutout 5 of neck seal 6 such that a tailored fit against a customer's neck is enabled. This applies for all of the exemplary embodiments.

Figure 4:
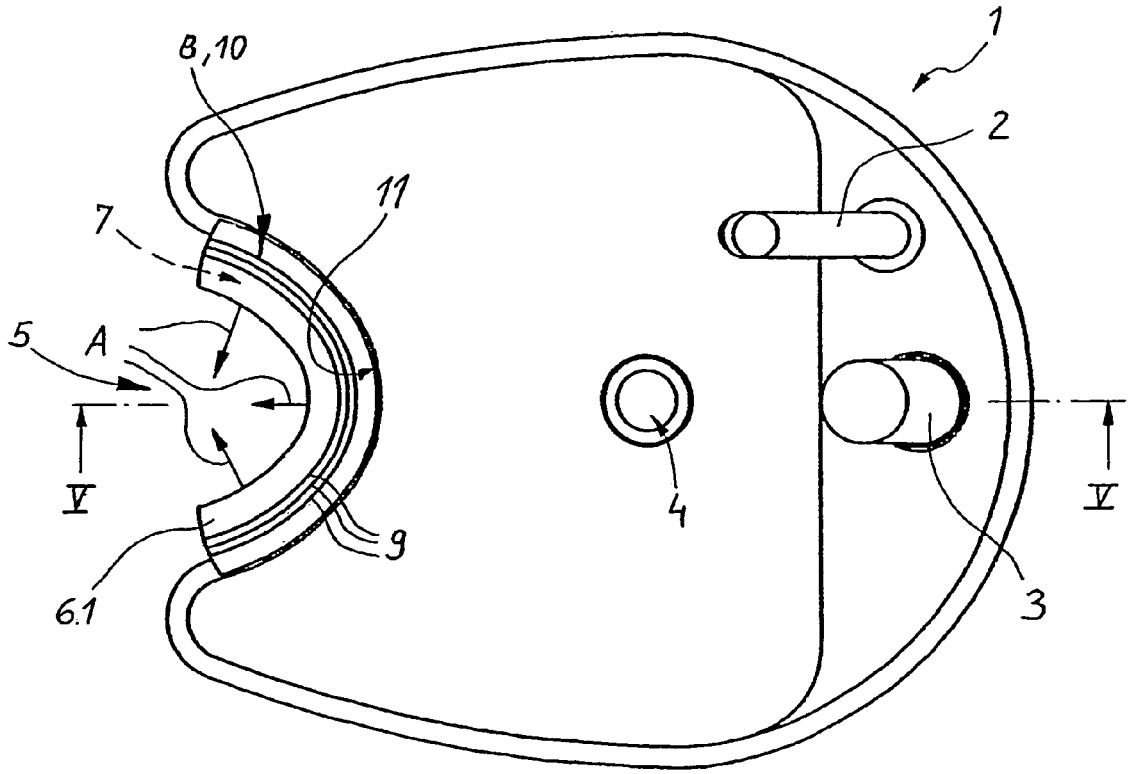
FIG. 4 shows a rearward wash basin with a neck seal in a top view, as a second exemplary embodiment.
Figure 5:
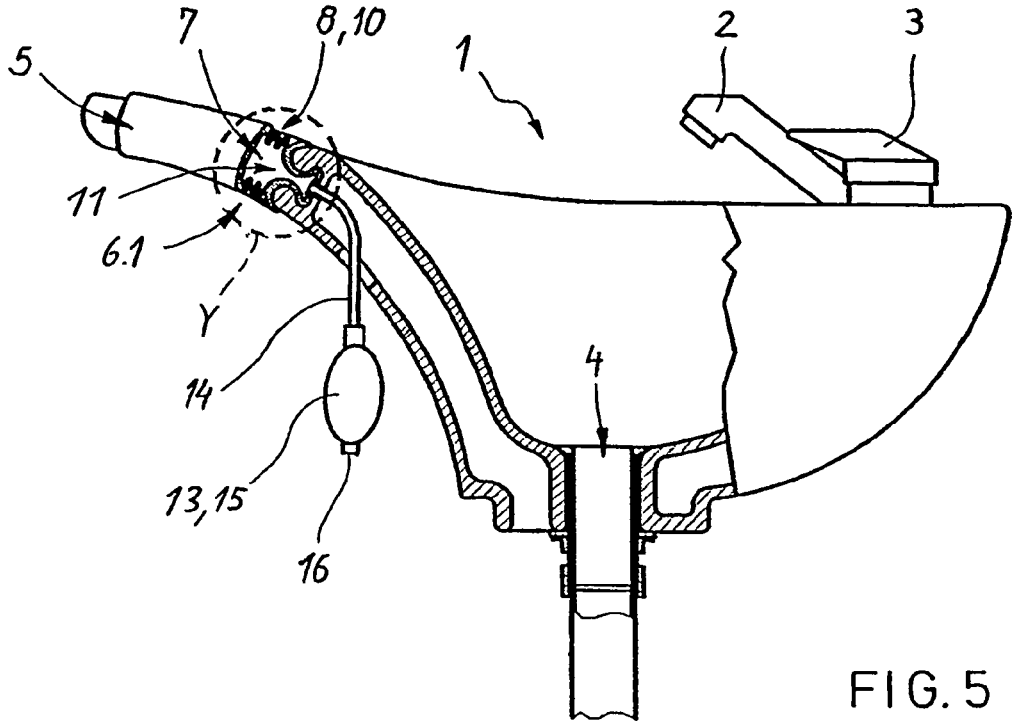
FIG. 5 is a partially side, partially sectional view of the rearward wash basin of FIG. 4 taken along the section line V—V of FIG. 4 showing neck seal capable of being filled with air.
Figure 6:
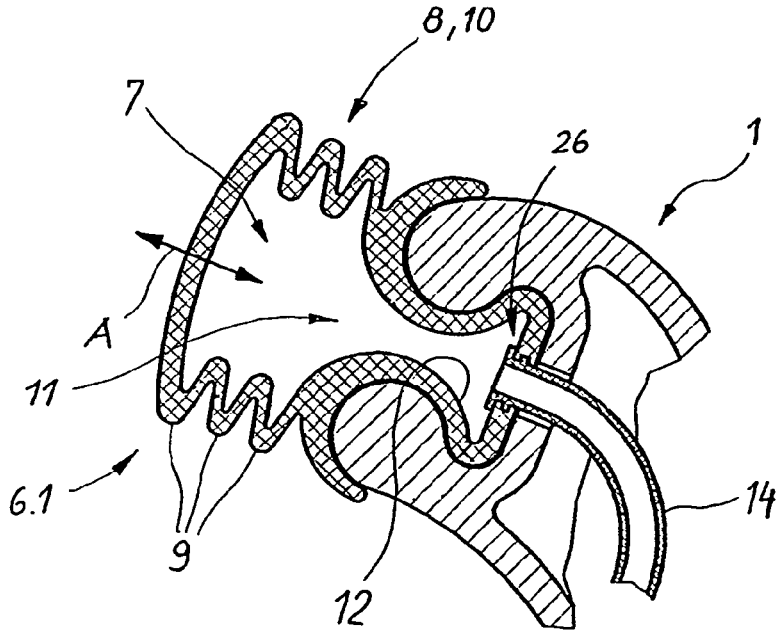
FIG. 6 is a detailed view of a circled region "Y" of the neck seal according to FIG. 5.

FIGS. 4 through 6 show a neck seal 6.1, in a second exemplary embodiment, whereby an air compressor 13, as an expansive displacement device 10, is interconnected with hollow chamber 7 via a combination air supply and release line 14 for the purpose of filling hollow chamber 7 with air to enable conformation (central displacement path A) to a customer's neck. A bellows 15 with an air release valve 16 can be provided as air compressor 13. A tailored fit is established by operating bellows 15. The fit is corrected and relaxed using air release valve 16.

FIG. 6 shows a detained view Y according to FIG. 5, which shows a better depiction of connection 26 of air supply and release line 14 with hollow chamber 7.

Figure 7:
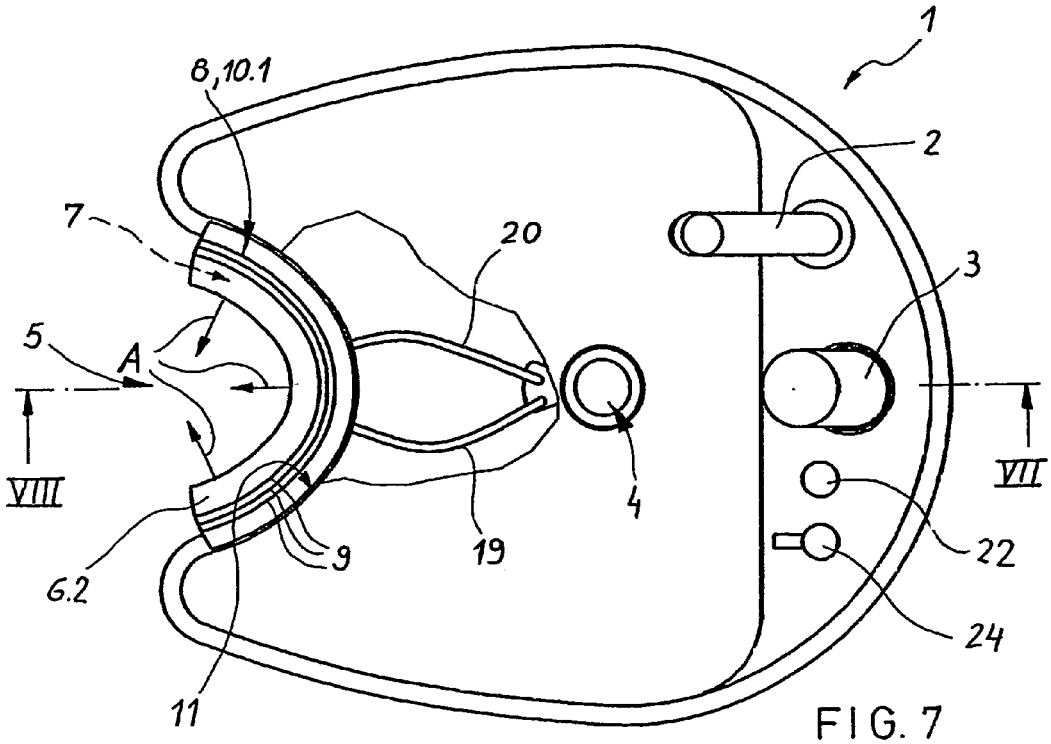
FIG. 7 shows a rearward wash basin in a top view with a neck seal that is capable of being filled with water, as a third exemplary embodiment.

FIG. 7 shows, in a top view of rearward wash basin 1, a third exemplary embodiment of a neck seal 6.2, whereby hollow chamber 7—as an expansive displacement device

10.1—is provided with a combination water pressure line 19 and a relief line 20, which is connected to a pressure relief valve 21 (FIG. 8), for the purpose of filling hollow chamber 7 with water 18 at a selected temperature for conformation (central displacement path A) to a customer's neck. Water 18, which is held at a steady temperature, provides comfort in the form of a pleasant feeling of warmth at the customer's neck. Neck seal 6.2 is relieved of pressure manually using an operating device 22, by way of which excess water 18 flows from pressure relief valve 21 (FIG. 8) through a passage 23 into drain 4. A switching valve 25 (FIG. 10) is controlled using a switching device 24 to supply water to either shower hose 2 or neck seal 6.2.

Figure 8:
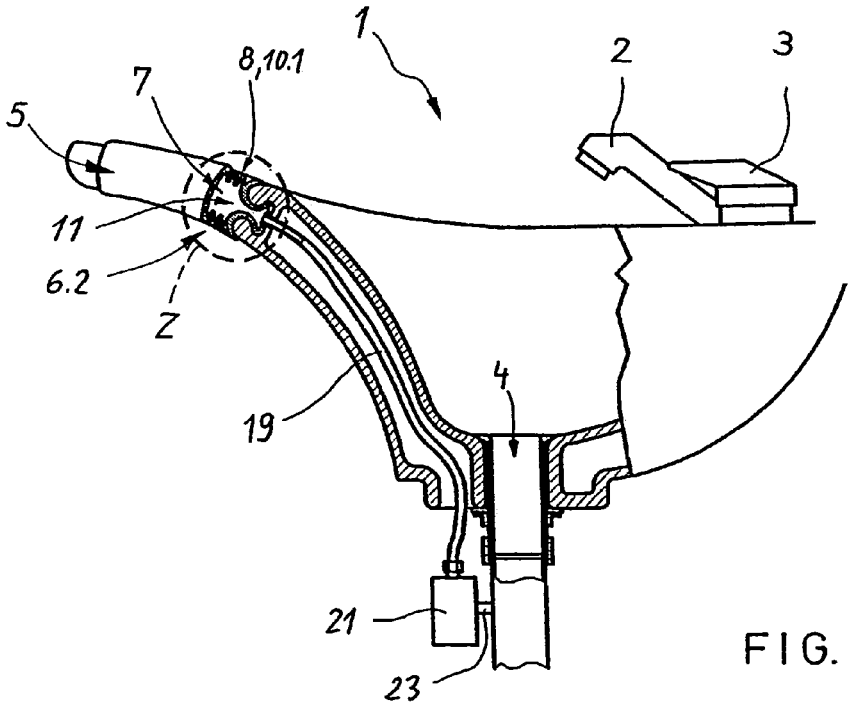
FIG. 8 is a partially side, partially sectional view of the rearward wash basin of FIG. 7 taken along the section line VIII—VIII of FIG. 7.

FIG. 8 shows a partially cut side view of rearward wash basin 1 according to FIG. 7, which shows the position of relief line 20 and pressure relief valve 21 with passage 23 in greater detail.

Figure 9:
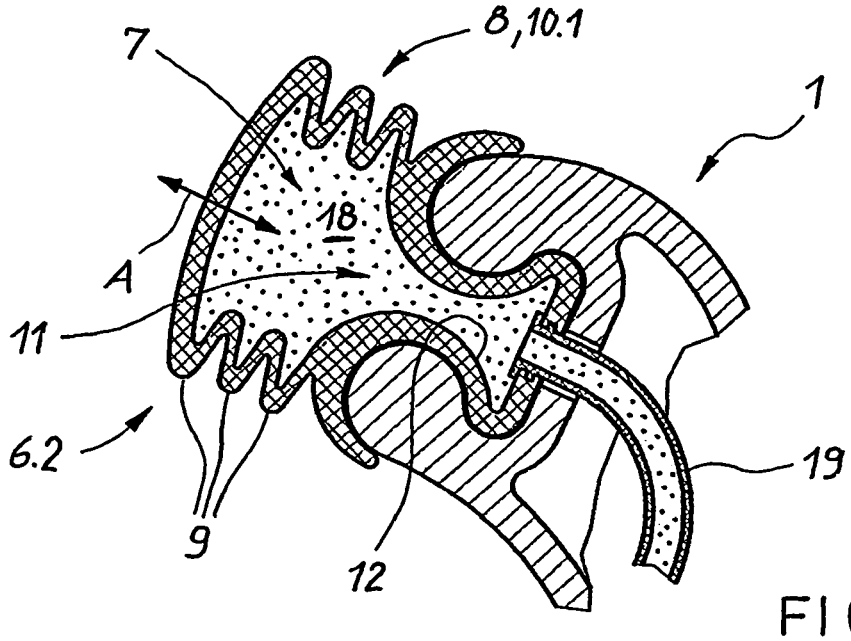
FIG. 9 is a detailed view of a circled region "Z" of the neck seal according to FIG. 8.

FIG. 9 shows a detained view Z according to FIG. 8; it shows connection 26 of pressure relief line 20 with neck seal 6.2 and hollow chamber 7 in greater detail.

The bodies of neck seals 6, 6.1, 6.2, which are preferably made of silicone, and the connection with rearward wash basin 1 are the same in all exemplary embodiments.

Figure 10:
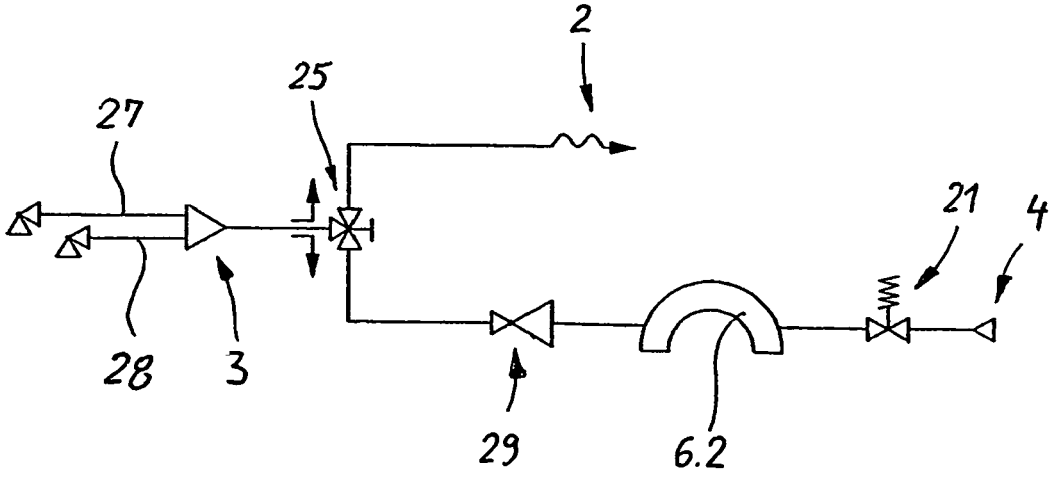
FIG. 10 is a schematic diagram of a device for adjusting the neck seal with water.

FIG. 10 shows an operational diagram with the functions of the third exemplary embodiment according to FIGS. 7 through 9. A cold water line 27 and a warm water line 28 lead to mixer tap 3, with which a predetermined water temperature can be adjusted, which prevents a customer from feeling a cold sensation. Mixer tap 3 is interconnected with switching valve 25, which allows water 18 to be applied to either shower hose 2 or neck seal 6.2. Neck seal 6.2 is interconnected with pressure relief valve 21 via relief line 20, whereby excess water 18 flows into drain 4. In order to reduce the water pressure in hollow chamber 7 of neck seal 6.2, a pressure reducer 29 is provided that reduces water pressure from 2.5 to 6 kp/cm$^2$, to 0.5 to 0.8 kp/cm$^2$.

Description of the Function:

After a person's neck is placed in neck cutout 5, the temperature of the water is adjusted using mixer tap 3. The water is then directed into hollow chamber 7 using switching valve 25. Manual pressure is applied briefly to pressure relief valve 21 to relieve the pressure on neck seal 6.2 so it can then be filled with an amount of water that can be regulated using mixer tap 3. When optimum adaptation to the particular neck contour is achieved, switching valve 25 is switched over, and the water flows out of the tap of the shower hose 2. If the pressure becomes too great, the pressure relief valve 21 is operated briefly to relieve the pressure. The excess amount of water flows into drain 4.

LIST OF REFERENCE NUMERALS

1 Rearward wash basin
2 Shower hose
3 Mixer tap
4 Drain
5 Neck cutout
6, 6.1, 6.2 Neck seal
7 Hollow chamber
8 Bellows
9 Folds
10, 10.1 Expansive displacement device
11 Recess
12 Recess profile
13 Air compressor
14 Air supply and release line
15 Bellows
16 Air release valve
17
18 Water
19 Water pressure line
20 Relief line
21 Pressure relief valve
22 Operating device/pressure relief valve
23 Passage
24 Switching device
25 Switching valve
26 Connection
27 Cold water line
28 Warm water line
29 Pressure reducer
A Expansive motion range
B Air supply and relief opening

What is claimed is:

1. A rearward wash basin comprising a neck cutout (5) for performing a rearward head or hair washing and a soft elastic neck seal (6) lining said neck cutout;

wherein said neck seal (6) is in the form of a first bellows (8) with folds (9), said neck seal (6) is provided with a hollow chamber (7) and said folds (9) have a curvature essentially corresponding to that of said neck cutout (5).

2. The rearward wash basin as defined in claim 1, wherein said neck seal (6) is equipped with an expansive displacement device (10, 10.1).

3. The rearward wash basin as defined in claim 2, wherein said expansive displacement device (10) comprises an air compressor (13) and said air compressor (13) is connected to the hollow chamber (7) by a combination air supply and release line (14).

4. The rearward wash basin as defined in claim 3, wherein the air compressor (13) comprises a second bellows (15) and said second bellows is equipped with an air release valve (16).

5. The rearward wash basin as defined in claim 2, wherein said expansive displacement device (10, 10.1) provides an expansive motion range (A) of approximately 20 mm.

6. The rearward wash basin as defined in claim 1, wherein said expansive displacement device (10.1) comprises said hollow chamber (7) and the hollow chamber (7) is connected with a water pressure line (19) and with a relief line (20) and pressure relief valve (21) is associated with the relief line.

7. The rearward wash basin as defined in claim 6, wherein the water pressure line (19) is equipped with a pressure reducer (29).

8. The rearward wash basin as defined in claim 1, wherein said neck seal (6) is composed of silicone.

9. The rearward wash basin as defined in claim 1, wherein said bellows (8) and said folds (9) are designed so that the soft elastic neck seal (6) adjusts to fit a users neck in operation and thus forms a fluid-tight seal between the user's neck and the neck seal, so that water is prevented from running along the user's neck into clothing of the user during the washing.

10. The rearward wash basin as defined in claim 1, wherein said bellows (8) and said folds (9) are designed, so that the soft elastic neck seal (6) adjusts to fit a users neck in operation over a range of motion (A) of about 20 mm.

* * * * *